United States Patent [19]

Hu et al.

[11] Patent Number: 4,704,994

[45] Date of Patent: Nov. 10, 1987

[54] FLOW BOOSTING AND SLUDGE MANAGING SYSTEM FOR STEAM GENERATOR TUBE SHEET

[75] Inventors: Min-Hsiung Hu, Murrysville Boro; Glen W. Hopkins, Forest Hills, both of Pa.

[73] Assignee: Westinghouse Electric Corp., Pittsburgh, Pa.

[21] Appl. No.: 852,875

[22] Filed: Apr. 16, 1986

[51] Int. Cl.[4] ..... F22B 1/16

[52] U.S. Cl. ..... 122/32; 122/379; 122/512; 165/161

[58] Field of Search ..... 122/32, 34, 235 F, 235 M, 122/379, 380, 390, 392, 411, 512; 165/159, 160, 161; 376/313, 377, 389, 399

[56] References Cited

U.S. PATENT DOCUMENTS

| | | | |
|---|---|---|---|
| 3,195,515 | 7/1965 | Blizard | 122/34 |
| 3,811,498 | 5/1974 | Ferraro et al. | 165/161 |
| 3,841,272 | 10/1974 | Mayer et al. | 122/32 |
| 4,079,701 | 3/1978 | Hickman et al. | 122/382 |
| 4,276,856 | 7/1981 | Dent et al. | 122/382 |
| 4,357,908 | 11/1982 | Yazidjian | 122/32 |
| 4,498,426 | 2/1985 | Leroy et al. | 122/32 |

FOREIGN PATENT DOCUMENTS

| | | | |
|---|---|---|---|
| 2159256 | 11/1985 | United Kingdom | 122/390 |

*Primary Examiner*—Albert J. Makay
*Assistant Examiner*—Steven E. Warner

[57] ABSTRACT

A nuclear steam generator vessel having a stayed tube sheet with an untubed circular central region in the upper surface thereof, a baffle plate disposed a predetermined distance above the tube sheet parallel thereto and a plurality of tube lane blocks spaced-apart longitudinally of a tube lane extending diametrically across the tube sheet, incorporates a system for controlling the flow velocity of secondary fluid along the tube sheet to reduce deposition of sludge thereon. The system includes a cylindrical flow boosting ring disposed coaxially with the central region and supported beneath the baffle plate a predetermined distance above the tube sheet. The ring may be used alone or in combination with one or both of two perpendicular vertical plates which extend diametrically across the central region in contact with the tube sheet, one of these plates lying along the tube lane axis and spanning the innermost ones of the tube lane blocks. When the ring is used with the vertical plates it is supported thereby.

20 Claims, 5 Drawing Figures

FLOW BOOSTING AND SLUDGE MANAGING SYSTEM FOR STEAM GENERATOR TUBE SHEET

BACKGROUND OF THE INVENTION

1. Field of the Invention:

The present invention relates to heat exchange vessels, such as nuclear steam generating vessels, and particularly to control of the flow of secondary fluid around the outsides of heat exchange tubes and management of the deposition of sludge on the tube sheet of such a heat exchanger.

2. Description of the Prior Art:

A typical nuclear steam generator comprises a vertically oriented shell or vessel and a plurality of inverted U-shaped tubes disposed in the shell so as to form a tube bundle. Each tube has a pair of elongated vertical portions interconnected at the upper end by a curved bight portion, so that the vertical portions of each tube straddle a center lane or passage through the tube bundle. A tube sheet supports the vertical portions of the tubes at their lower ends. In some steam generator vessels, the tube sheet is "stayed" from beneath by a central support post and has no tubes in the central region overlying the support post. The upper surface of the tube sheet may have a shallow cavity in this central region.

The vertical tube portions on one side of the center lane communicate with a primary fluid inlet header beneath the tube sheet and form the "hot leg" of the tube bundle, and those on the other side of the center lane communicate with a primary fluid outlet header beneath the tube sheet, forming the "cold leg" of the tube bundle. The steam generator also comprises a cylindrical wrapper sheet disposed between the tube bundle and the shell, cooperating with the shell to form an annular downcomer chamber, terminating a predetermined distance above the tube sheet.

The primary fluid, having been heated by circulation through the reactor core, enters the steam generator through the primary fluid inlet header, is transmitted through the tube bundle and out through the primary fluid outlet header. At the same time, a secondary fluid or feedwater is circulated around the tubes above the tube sheet in heat transfer relationship with the outside of the tubes, so that a portion of the feedwater is converted to steam, which is then circulated through standard electrical generating equipment. More particularly, the feedwater is conducted down the annular chamber along the outside of the wrapper and to the tube sheet, radially inwardly along the tube sheet and upwardly among the tubes inside the wrapper.

The feedwater contains particles of material, mainly in the form of iron oxides and copper compounds along with traces of other metals, which tend to settle out of the feedwater onto the tube sheet in those areas of the tube sheet where the velocity of lateral flow across the tube sheet is insufficient to prevent settling. The settling is harmful because it creates buildups of sludge deposits which provides sites for concentration of corrosive agents at the tube walls that result in tube corrosion.

It is inevitable that regions of low lateral or radial velocity across the tube sheet will be formed in the tube bundle. In order to minimize damage caused by sludge build-up in such low velocity areas, it is desirable to localize this buildup to the regions of the tube sheet where there are no tubes, e.g., along the center tube lane or at the untubed central region of the tube sheet. Thus, it is desirable to control the flow of secondary fluid so that the regions of low lateral or radial velocity occur in these regions without tubes. An optimal design is one which yields the smallest low velocity area and, at the same time, locates it at the center of the tube sheet.

The flow pattern of the secondary fluid is affected by a number of factors. As the feedwater enters the tube bundle from beneath the tube wrapper, the radial inward flow along the tube sheet is impeded by the tubes. Since there are no tubes along the tube lane, there tends to be relatively high flow velocity therealong. To minimize tube lane flow velocity, there have been provided tube lane blocks at spaced-apart locations along the center lane to inhibit the flow of feedwater therealong, and thereby increase the flow velocity in the regions of the tube sheet where there are tubes. But this does not serve to eliminate the presence of other low velocity regions in the tube bundle.

Heat transfer rate in the "hot leg" in the tube bundle is about 4 to 5 times that in the "cold leg" in the vertical region between the tube sheet and the first of the several tube support plates. This results in boiling of the feedwater in this region of the "hot leg", generating vapors. The buoyancy force associated with the steam vapors can pull the feedwater in the "cold leg" toward the "hot leg", a phenomenon known as "thermal siphon". This "thermal siphon" causes a low velocity zone of the secondary fluid flow to appear in the middle of the "hot leg" part of the tube bundle. Attempts have been made to counteract this "thermal siphon" effect by a technique known as "feedwater offset", whereby a larger fraction of the total feedwater is discharged into the downcomer path on the "hot leg" side of the vessel than on the "cold leg" side. The resulting greater cooling of the water may be maintained throughout the downcomer path and, thus, at the wrapper inlet, thereby significantly reducing "hot leg" boiling and thereby suppressing the "thermal siphon" effect. But, this technique has been ineffective because of a swirling motion which exists within the downcomer path.

When the feedwater enters the tube bundle through the opening at the bottom of the wrapper, the radial inlet flow has a tendency to immediately turn upward, since the flow resistance in the vertical direction, parallel to the tubes, is much less than that in the lateral or radial direction. This results in weak penetration of the radial flow into the tube bundle in the vicinity of the tube sheet. Therefore, means have been utilized to enhance radial flow velocity by reducing vertical flow velocity. To this effect, a flow distribution baffle plate has been utilized a predetermined distance above the tube sheet, to provide additional resistance to vertical axial flow, and thereby promote lateral flow penetration into the bundle. But, this has been insufficient to move the low velocity or stagnation areas to the center of the tube sheet.

SUMMARY OF THE INVENTION

It is a general object of the present invention to provide a system of controlling secondary fluid flow patterns and managing sludge deposition in a heat exchange vessel, which avoids disadvantages of prior systems while affording additional structural and operating advantages.

An important feature of the invention is the provision of a system of the type set forth which is of simple and economical construction.

Another feature of the invention is the provision of a system of the type set forth which effectively serves to locate areas of low lateral velocity or stagnation at the center of the tube sheet of the heat exchanger.

Another feature of the invention is the provision of a system of the type set forth, which enhances radial or lateral flow along the tube sheet in regions just outside the central region.

Yet another feature of the invention is the provision of a system of the type set forth, which inhibits the "thermal siphon" effect.

In connection with the foregoing features, it is another feature of the invention to provide a system of the type set forth which concentrates sludge deposition at the center of the tube sheet.

These and other features of the invention are attained by providing in a heat exchanger including a pressure vessel closed at one end by a tube sheet, a plurality of heat exchange tubes within the vessel extending into the tube sheet outside of a circular central region thereof and providing heat exchange between a primary fluid flowing therethrough and a secondary fluid flowing therearound in a flow path extending generally radially inwardly along the tube sheet and axially upwardly along the tubes, and a baffle plate disposed above the tube sheet substantially parallel thereto, the improvement comprising: a circularly cylindrical flow boosting member disposed coaxially with the central region, and means supporting the member beneath the baffle plate and a predetermined distance above the tube sheet, the member serving to increase the radial flow velocity of the secondary fluid along the tube sheet before it enters the central region thereof.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there are illustrated in the accompanying drawings preferred embodiments thereof, from an inspection of which, when considered in connection with the following description, the invention, its construction and operation, and many of its advantages should be readily understood and appreciated.

DESCRIPTION OF THE PREFERRED EMBODIMENTS

Figure 1:
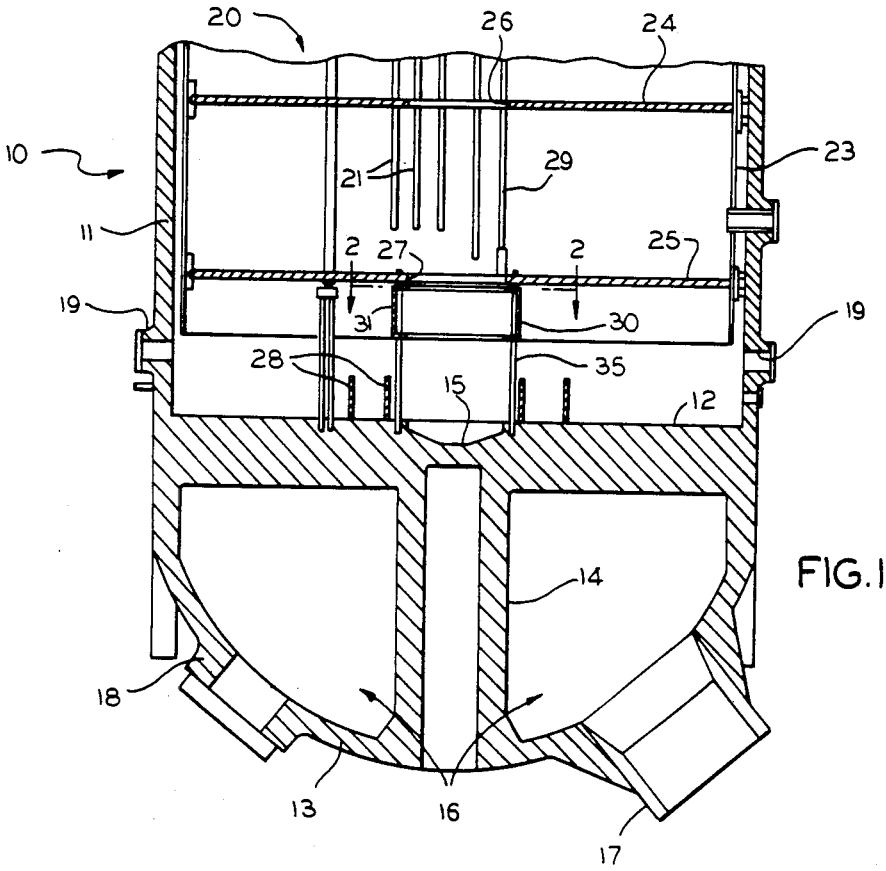
FIG. 1 is a fragmentary view in vertical section illustrating the lower end of a nuclear steam generating vessel incorporating a first embodiment of the present invention.

Referring to FIG. 1, there is illustrated a nuclear steam generator vessel, generally designated by the numeral 10, which includes an elongated, generally cylindrical side wall 11. Extending across and closing the vessel 10 adjacent to the lower end thereof is a circular tube sheet 12. The vessel 10 has a generally hemispherical lower end 13 extending beneath the tube sheet 12 and connected thereto by a center stay 14. A generally circular central recess 15 may be formed in a central region of the upper surface of the tube sheet 12 immediately above the center stay 14. A dividing wall (not shown) divides the area between the tube sheet 12 and the lower end 13 into two plenum chambers or headers 16, each provided with a nozzle 17 (one shown) and a manway 18 (one shown). The nozzles 17 are respectively coupled by conduits (not shown) to an associated nuclear reactor. The manways 18 have removable covers for providing access to the headers 16. Formed in the side wall 11, a slight distance above the tube sheet 12, are two or more handholes 19 provided with removable covers (not shown) for affording access to the interior of the vessel 10 above the tube sheet 12.

Disposed in the vessel 10 above the tube sheet 12 is a tube bundle 20 comprising a plurality of inverted U-shaped tubes 21, the legs of each tube 21 straddling a center tube lane 22 (see FIG. 2) which extends diametrically across the tube sheet 12, parallel to the axis of at least two of the handholes 19. Each tube 21 has the two legs thereof communicating, respectively, with the headers 16 through openings (not shown) in the tube sheet 12. No tubes 21 are disposed in the central region of the tube sheet 12 occupied by the recess 15. A cylindrical wrapper 23 encircles the tube bundle 20 coaxially with the side wall 11 and spaced a slight distance inwardly of the inner surface thereof for cooperation therewith to define therebetween an annular downcomer passage. The wrapper 23 terminates a predetermined distance above the tube sheet 12. A blowdown pipe (not shown) may be provided along the center tube lane 22 just above the tube sheet 12.

A plurality of vertically spaced-apart tube support plates 24 (one shown) are provided for supporting and positioning the tubes 21. A baffle plate 25 may be provided beneath the bottom tube support plate 24 a predetermined distance above the tube sheet 12. The tube support plates 24 and the baffle plate 25 are respectively provided with circular central cutouts 26 and 27 coaxial with the central recess 15 in the tube sheet 12, since no tubes 21 are provided in this central region. A plurality of rectangular tube lane blocks 28 may be provided in the center tube lane 22, spaced apart longitudinally thereof, each of the tube lane blocks 28 projecting vertically upwardly from the tube sheet 12. If a blowdown pipe is provided, suitable apertures will be provided in the tube lane blocks 28 to accommodate it. Stay rods 29 may also be provided to facilitate support of the tube support plates 24 and the baffle plate 25.

In operation, primary fluid from the reactor core is circulated into a first one of the headers 16, through the tube bundle 20, and then outwardly through the second one of the header 16 back to the reactor core. The vertical portion of the tube bundle 20 communicating with the input header 16 is referred to as the "hot leg" of the tube bundle, while the leg communicating with the output header 16 is referred to as the "cold leg". Secondary feedwater is circulated in the vessel 10 above the tube sheet 12 in heat-exchange relationship with the tube bundle 20. More particularly, the feedwater circulates downwardly through the annular channel between the vessel side wall 11 and the wrapper 23, impinges on the tube sheet 12 and moves radially inwardly therealong beneath the lower end of the wrapper 23. The feedwater then circulates upwardly through the tube bundle 20, all in a known manner.

The flow velocity of the feedwater laterally or radially across the tube sheet 12 may vary at different regions of the tube sheet 12. This flow velocity, if sufficient, can prevent the buildup of sludge on the tube sheet 12 from the settling of deposits from the feedwater. Thus, in order to maximize the lateral flow velocity in the region of the tube bundle 20, it is desirable to minimize flow velocity in the center tube lane 22 where there are no tubes. To this end, the tube lane blocks 28 may be utilized to inhibit the flow of feedwater along the center tube lane 22.

In general, when the feedwater impinges on the tube sheet 12 it tends to be deflected therefrom and move upwardly through the tube bundle 20, the vertical flow velocity through the tube bundle 20 tending to be greater than the radial flow velocity along the tube sheet 12, because the radial flow is inhibited by the presence of the tubes, whereas there is less resistance to the vertical flow. The baffle plate 25 is provided to reduce this vertical flow velocity, thereby tending to increase the flow velocity radially inwardly along the tube sheet 12. Nevertheless, despite the use of the baffle plate 25 and the tube lane blocks 28, there are still regions of stagnation or low velocity within the tube bundle 20 along the tube sheet 12. Since, in general, the flow resistance increases with distance from the sidewall 11, the flow velocity tends to reduce to a minimum before reaching the untubed central region of the recess 15.

Figure 2:
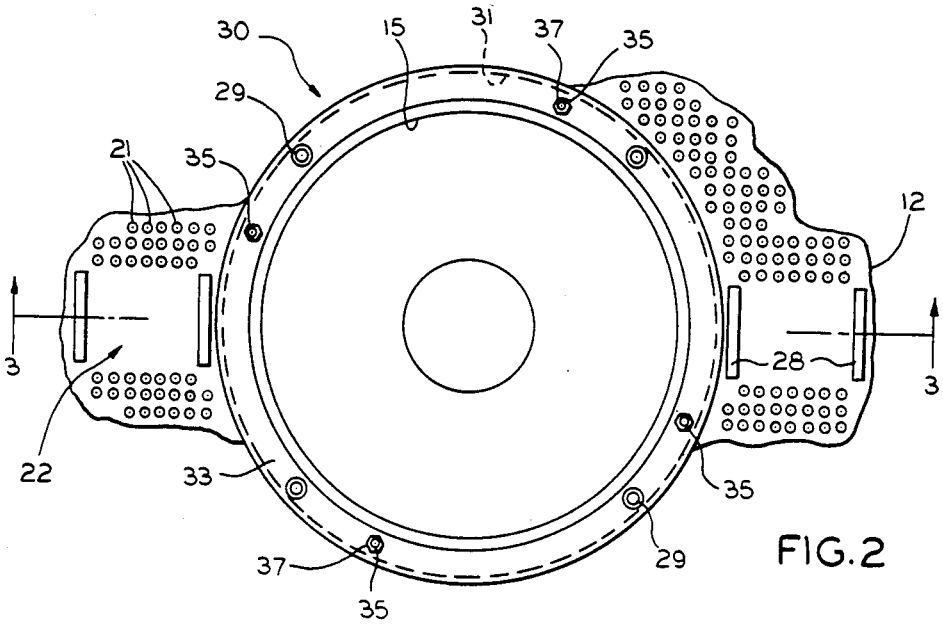
FIG. 2 is an enlarged, fragmentary, top plan view of the first embodiment of the present invention, taken generally along the line 2—2 in FIG. 1.
Figure 3:
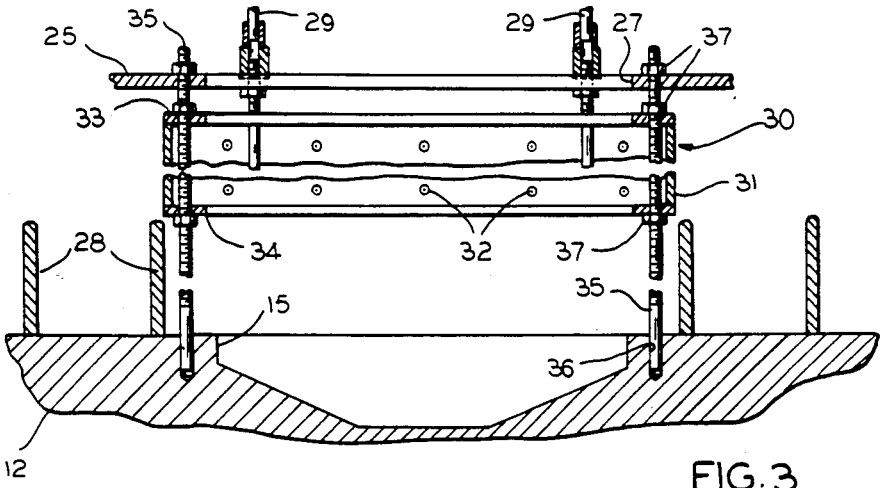
FIG. 3 is a fragmentary view in vertical section taken along the line 3—3 in FIG. 2.

Referring now in particular to FIGS. 1–3, there is provided a first embodiment of the present invention to enhance the flow of feedwater radially inwardly along the tube sheet 12, particularly in the regions near the untubed central region of the recess 15. To this end, there is provided a flow booster 30, which includes a circularly cylindrical body 31 disposed in use substantially coaxially with the tube sheet 12 and having a diameter slightly less than the diameter of the untubed central region. The cylindrical body 31 preferably has a plurality of perforations 32 formed therethrough (see FIG. 3). Integral with the cylindrical body 31 at the upper and lower edges thereof, respectively, are radially inwardly extending annular upper and lower support flanges 33 and 34. The flow booster 30 is supported in place by a plurality of vertical support rods 35, each having the lower end thereof anchored in an associated bore 36 in the tube sheet 12. The support rods 35, which may be four in number, extend upwardly through complementary openings in the support flanges 33 and 34 and in the baffle plate 25, being locked in position by a plurality of nuts 37 to position and support the cylindrical body 31 on the rods 35. Preferably, the flow booster 30 is mounted just beneath the baffle plate 25, with the lower end of the flow booster 30 being spaced a predetermined distance above the tube sheet 12.

In operation, the flow booster 30 constricts the radial flow passage defined between the tube sheet 12 and the baffle plate 25. Thus, in the region of the flow booster 30, the bulk of the radial feedwater flow is forced to pass beneath the flow booster 30 and close to the tube sheet 12 to escape upwardly through the center of the flow booster 30 and through the center cutouts 27 and 26 in the baffle plate 25 and the tube support plates 24. This causes the flow velocity to increase as it passes beneath the flow booster 30 to provide good sweeping of the tube sheet 12 in the regions immediately adjacent to the untubed central region of the recess 15. The preforations 32 in the flow booster 30 are provided to minimize local flow stagnation and vapor buildup as the upper layers of the radial feedwater flow impinge on the flow booster 30.

The use of the flow booster 30 has been found to significantly reduce the low velocity areas in the tube bundle 20 and serves to localize the low velocity or stagnation areas in the untubed central region of the recess 15 of the tube sheet 12. It has been found that, for best results, the vertical extent of the cylindrical body 31 must be selected so that the distance between the bottom thereof and the tube sheet 12 is in a predetermined optimum range since, if this distance is either too great or too small, there will be no significant lateral flow velocity increase. In particular, it has been found that the vertical height of the cylindrical body 31 should be between 25% and 75% of the vertical distance between the tube sheet 12 and the baffle plate 25 and, preferably, about 4/7 of this distance. Thus, since the flow booster 30 is preferably mounted immediately beneath the baffle plate 25, the distance from the bottom of the booster 30 to the tube sheet 12 is approximately ½ the distance between the tube sheet 12 and the baffle plate 25. The perforations 32 in the cylindrical body 31 are sized and arranged to provide an overall porosity of approximately 10% of the total outer surface area of the cylindrical body 31.

A significant advantage of use of the flow booster 30 is that it permits the baffle plate 25 to be installed at a greater height above the tube sheet 12, so as to replace one of the tube support plates 24. Traditionally, the baffle plate 25 was installed about 20" above the tube sheet 12, or about midway between the tube sheet 12 and the lowermost one of the tube support plates 24. This low positioning of the baffle plate 25 was found to be disadvantageous for a number of reasons. One of these was the fact that the provision of the baffle plate 25 in addition to the tube support plates 24 afforded approximately 10,000 additional intersections with the tubes 21, each of which intersections is a potential site for the condition known as "crevice corrosion", which results from the feedwater boiling dry at these intersections. If the baffle plate 25 can be moved higher, to about the level of the lowermost tube support plate 24, it can be used in substitution for that support plate 24. Heretofore, that has not been possible, since when the distance between the baffle plate 25 and the tube sheet 12 was thus increased, the total lateral flow area was correspondingly increased and the lateral feedwater flow velocity was reduced to the point where sludge buildup was unacceptable.

By use of the flow booster 30, the baffle plate 25 can be raised to replace the bottom tube support plate 24, without adversely affecting feedwater lateral flow velocity along the tube sheet 12. This also permits the baffle plate 25 to be provided with larger tube openings to thereby increase axial tube flow along the tube bundle 30 and thereby further reduce the "crevice corrosion" phenomenon. Before the present invention, such an increase in axial feedwater flow was not permissible, since the adverse effect on lateral flow velocity created unacceptable sludge buildup on the tube sheet 12. Furthermore, because the baffle plate 25 can be raised, this permits the lower end of the wrapper 23 to be raised so that it does not block the handholes 19.

Figure 4:
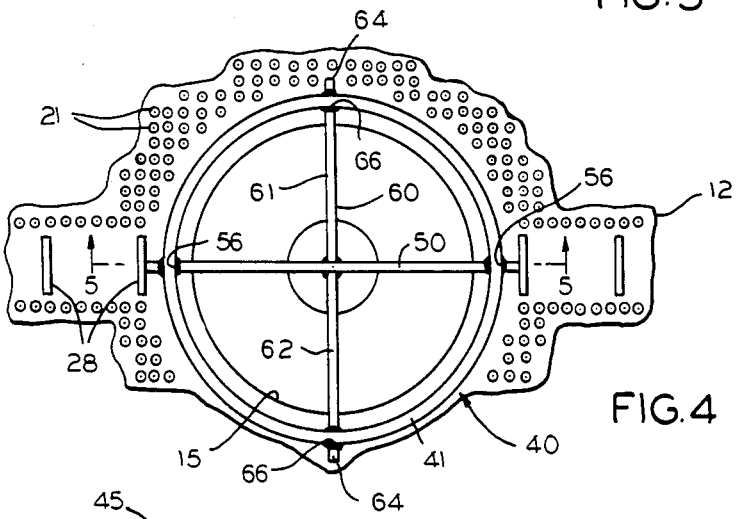
FIG. 4 is a slightly reduced view similar to FIG. 2, illustrating another embodiment of the present invention.
Figure 5:
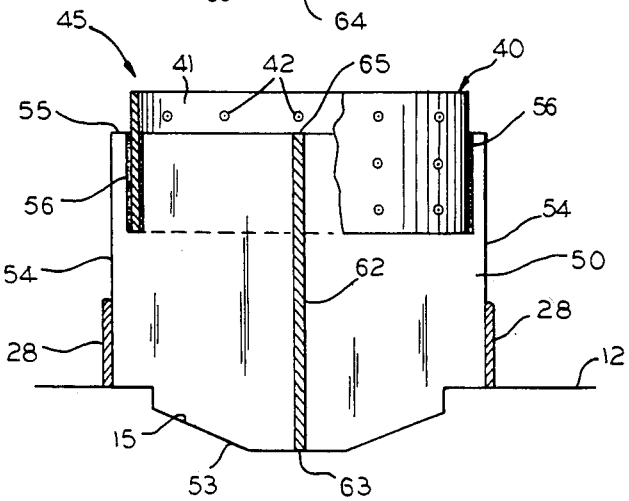
FIG. 5 is a view in vertical section taken along the line 5—5 in FIG. 4.

While the flow booster 30 has been found to provide improved flow distribution of the feedwater, the thermal siphon effect can still tend to move the areas of low lateral flow velocity off center and into the "hot leg" side of the tube bundle 20. In order to counteract this "thermal siphon" effect, there is provided a system 45 incorporating a second embodiment of the invention. Referring to FIGS. 4 and 5, the system 45 includes a flow booster 40, which is similar to the flow booster 30, and it additionally includes a siphon stopper plate 50 and a sludge trap promoter plate 60. In particular, the flow booster 40 includes a circularly cylindrical body 41 disposed coaxially with the untubed central region of the recess 15 and provided with a plurality of perforations 42 therethrough. The construction of the flow booster 40 may be substantially the same as that of the flow booster 30, described above.

The siphon stopper plate 50 is a solid vertical plate fixedly secured to the tube sheet 12, as by welding, and extending diametrically across the untubed central region of the recess 15 parallel to the longitudinal axis of the center tube lane 22. In the preferred embodiment of the invention, the siphon stopper plate 50 extends along the longitudinal axis of the center tube lane 22, spanning the distance between the innermost ones of the tube lane blocks 28. The siphon stopper plate 50 has a bottom edge 53 which follows the contour of the tube sheet 12 along the central recess 15 therein in intimate contact therewith along the entire length of the bottom edge 53. The plate 50 has parallel vertical side edges 54 which terminate at a horizontal top edge 55, provided with a pair of spaced-apart notches 56 therein for receiving the flow booster 40 for supporting same.

The sludge trap promoter plate 60 is substantially identical to the siphon stopper plate 50 and extends perpendicular thereto, diametrically across the untubed central region of the recess 15. The sludge trap promoter plate 60 is preferably formed in two sections 61 and 62, respectively disposed on either side of the siphon stopper plate 50 and secured thereto, as by welding. The plate 60 has a bottom edge 63 which follows the contours of the tube sheet 12 along the central recess 15 and in intimate contact therewith along the entire length of the bottom edge 63. The plate 60 has vertical side edges 64 which terminate at a horizontal top edge 65, in which are formed two spaced-apart notches 66 (see FIG. 4) for receiving the flow booster 40 in supporting relationship therewith. The flow booster 40 may be fixedly secured to the plates 50 and 60, as by welding.

In operation, the flow booster 40 functions in the same manner as the flow booster 30, described above. The siphon stopper plate 50 effectively stops the thermal siphon flow across the center tube lane 22 in the central region of the tube sheet 12, where the thermal siphon effect is greatest. Thus, the siphon stopper plate 50 cooperates with the flow booster 40 to force the low velocity area to settle at the untubed central region of the recess 15 of the tube sheet 12. The main function of the sludge trap promoter plate 60 is to cooperate with the siphon stopper plate 50 and the flow booster 40 to form four sludge trapping areas, which are hydraulically substantially quiescent and stable zones in which sludge should settle. The sludge trap promoter plate 60 also serves to assist the siphon stopper plate 50 in supporting the flow booster 40.

Preferably, the height of the siphon stopper plate 50 is approximately $\frac{1}{3}$ to $\frac{3}{4}$ of the height of the baffle plate 25 above the tube sheet 12, but it may extend all the way to the baffle plate 25 without adverse effect. In any event, the top edge 55 of the plate 50 must be disposed above the bottom of the flow booster 40. Preferably, the width of the siphon stopper plate 50 is approximately equal to the diameter of the flow booster 40. In the preferred embodiment, the width is slightly greated than the diameter of the flow booster 30, so that the plate 50 extends all the way between the innermost ones of the tube lane blocks 28.

From the foregoing, it can be seen that there has been provided an improved system for controlling feedwater flow and sludge buildup in a heat exchanger, the system including a flow booster ring, used either alone or in combination with a thermal siphon stopper plate and a sludge trap promoter plate, for localizing the region of low lateral feedwater velocity to the untubed central region of a center-stayed tube sheet.

We claim as our invention:

1. In a heat exchanger including a pressure vessel closed at one end by a tube sheet and having a generally cylindrical side wall, a plurality of heat exchange tubes within the vessel extending into the tube sheet outside of a circular central region thereof and providing heat exchange between a primary fluid flowing therethrough and a secondary fluid flowing therearound in a flow path extending generally radially inwardly along the tube sheet and axially upwardly along the tubes, a circularly cylindrical wrapper spaced inwardly from the side wall encompassing the plurality of tubes, and a baffle plate disposed above the tube sheet substantially parallel thereto, the improvement comprising: a circularly cylindrical flow boosting member disposed radially inwardly of the wrapper coaxially with the central region, and means supporting said member beneath the baffle plate and a predetermined distance above the tube sheet, said member serving to increase the radial flow velocity of the secondary fluid along the tube sheet before it enters the central region thereof.

2. The heat exchanger of claim 1, wherein said predetermined distance is approximately half the vertical distance between the tube sheet and the baffle plate.

3. The heat exchanger of cliam 1, wherein said flow boosting member has a diameter less than or equal to the diameter of the central region.

4. The heat exchanger of claim 1, wherein said supporting means includes a plurality of support rods extending between the tube sheet and the baffle plate.

5. The heat exchanger of claim 4, wherein said flow boosting member includes a pair of radially inwardly extending annular flanges at the upper and lower ends thereof for engagement with said support rods.

6. The heat exchanger of claim 1, wherein said flow boosting member has an axial height in the the range of from about 25% to about 75% of the vertical distance between the tube sheet and the baffle plate.

7. The heat exchanger of claim 4, wherein said axial height is approximately 4/7 of the vertical distance between the tube sheet and the baffle plate.

8. The heat exchanger of claim 1, wherein said flow boosting member has perforations therein.

9. The heat exchanger of claim 8, wherein the perforations in said flow boosting member are of a number and size such that the total perforations area is approximately 10% of the total outer surface area of said member.

10. In a heat exchanger including a pressure vessel closed at one end by a circular tube sheet and having a generally cylindrical side wall, a plurality of heat exchange tubes within the vessel extending into the tube sheet outside of a circular central region thereof and on either side of a tube lane having an axis extending diametrically across the tube sheet, the tubes providing heat exchange between a primary fluid flowing therethrough and a secondary fluid flowing therearound in a flow path extending generally radially inwardly along the tube sheet and axially upwardly along the tubes, a circularly cylindrical wrapper spaced inwardly from the side wall encompassing the plurality of tubes, and a baffle plate disposed above the tube sheet substantially parallel thereto, the improvement comprising: a circularly cylindrical flow boosting member disposed radially inwardly of the wrapper coaxially with the central region, and means supporting said member beneath the baffle plate and a predetermined distance above the tube sheet, said supporting means including vertical plate means fixedly secured to the tube sheet and extending diametrically across the central region thereof parallel to the axis of the tube lane, said plate means having a bottom edge contacting the tube sheet and a top edge disposed above the bottom of the flow boosting member, said flow boosting member serving to increase the radial flow velocity of the secondary fluid along the tube sheet as it enters the central region thereof, said plate means serving to inhibit horizontal flow of the secondary liquid along the tube sheet across the central region thereof in directions perpendicular to said plate means.

11. The heat exchanger of claim 10, wherein said vertical plate means is disposed along the tube lane axis.

12. The heat exchanger of claim 10, wherein said vertical plate means has a pair of spaced-apart notches in the upper edge thereof for receiving said flow boosting member in supporting engagement therewith.

13. The heat exchanger of claim 10, and further comprising a second vertical plate means extending diametrically across the central region substantially perpendicular to the first vertical plate means and cooperating therewith to support said flow boosting member.

14. The heat exchanger of claim 10, and further comprising a plurality of tube lane blocks spaced-apart longitudinally of the tube lane and extending vertically upwardly from the tube sheet.

15. The heat exchanger of claim 14, wherein the height of said vertical plate means above the tube sheet is greater than the height of said tube length blocks.

16. The heat exchanger of claim 15, wherein said vertical plate means spans the innermost ones of said tube lane blocks.

17. In a heat exchanger including a pressure vessel closed at one end by a tube sheet, and a plurality of heat exchange tubes within the vessel extending into the tube sheet outside of a circular central region thereof and on either side of a tube lane having an axis extending diametrically across the tube sheet, the tubes providing heat exchange between a primary fluid flowing therethrough and a secondary fluid flowing therearound in a flow path extending generally radially inwardly along the tube sheet and axially upwardly along the tubes, and a baffle plate disposed above the tube sheet substantially parallel thereto, the improvement comprising: first and second vertical plate means fixedly secured to the tube sheet and projecting upwardly therefrom and disposed substantially perpendicular to each other, each of said plate means extending diametrically across the central region and having a bottom edge contacting the tube sheet and a top edge spaced a predetermined distance below the baffle plate, said first plate means extending parallel to the axis of the tube lane, whereby said first and second plate means cooperate to minimize the horizontal flow velocity of the secondary fluid in the central region of the tube sheet.

18. The heat exchanger of claim 17, wherein said first plate means extends along the tube lane axis.

19. The heat exchanger of claim 17, wherein said first and second vertical plate means extend the same distance above the tube sheet.

20. The heat exchanger of claim 17, and further comprising a plurality of tube lane blocks extending vertically upwardly from the tube sheet and spaced apart longitudinally of the tube lane, each of said first and second vertical plate means having a height above the tube sheet greater than the height of said tube lane blocks, said first vertical plate means spanning the innermost ones of said tube lane blocks.

* * * * *